US008240938B2

(12) United States Patent
Maxwell

(10) Patent No.: US 8,240,938 B2
(45) Date of Patent: Aug. 14, 2012

(54) OVER CAP BRUSH FOR DISPENSING BOTTLE

(75) Inventor: Charles P. Maxwell, Mequon, WI (US)

(73) Assignee: Tablecraft Products Company, Cleveland, OH (US)

( * ) Notice: Subject to any disclaimer, the term of this patent is extended or adjusted under 35 U.S.C. 154(b) by 499 days.

(21) Appl. No.: 12/484,277

(22) Filed: Jun. 15, 2009

(65) Prior Publication Data

US 2010/0316434 A1 Dec. 16, 2010

(51) Int. Cl.
*A46B 11/00* (2006.01)

(52) U.S. Cl. ..... 401/290; 401/268

(58) Field of Classification Search ..... 401/268, 401/269, 282, 290
See application file for complete search history.

(56) References Cited

U.S. PATENT DOCUMENTS

| | | | | |
|---|---|---|---|---|
| D165,109 | S | 4/1951 | Petrosky | |
| 3,029,464 | A | 4/1962 | Springmeier | |
| 3,351,415 | A | 11/1967 | Hoffman | |
| 3,521,968 | A | 7/1970 | Wise | |
| 4,533,273 | A | 8/1985 | Obata et al. | |
| 5,066,157 | A | 11/1991 | Liff | |
| 5,186,563 | A | 2/1993 | Gebhard et al. | |
| 5,547,303 | A | 8/1996 | Pyrozyk | |
| D376,048 | S | 12/1996 | Gerhart et al. | |
| D376,479 | S | 12/1996 | Bresler et al. | |
| 5,641,233 | A | 6/1997 | Wilson | |
| D400,358 | S | 11/1998 | Zemel | |
| 5,934,187 | A | 8/1999 | Leon | |
| 6,000,405 | A | 12/1999 | De Laforcade | |
| 6,315,483 | B1 | 11/2001 | Velliquette | |
| 6,457,894 | B1 | 10/2002 | Miles | |
| 6,805,512 | B2 | 10/2004 | King | |
| D511,896 | S | 11/2005 | Wu | |
| D544,714 | S | 6/2007 | Zemel | |
| D550,965 | S | 9/2007 | Kaposi | |
| D550,966 | S | 9/2007 | Kaposi | |
| 7,373,686 | B2 | 5/2008 | Foster et al. | |
| 7,878,727 | B2 * | 2/2011 | Koptis | 401/126 |
| 2004/0240929 | A1 | 12/2004 | Watson | |
| 2005/0117962 | A1 | 6/2005 | Lion et al. | |
| 2006/0239758 | A1 | 10/2006 | Di Paolo | |
| 2007/0143945 | A1 | 6/2007 | DiPietro et al. | |
| 2007/0201941 | A1 | 8/2007 | Koptis | |

* cited by examiner

*Primary Examiner* — David Walczak
(74) *Attorney, Agent, or Firm* — Pearne & Gordon LLP

(57) ABSTRACT

An over cap brush for a squeeze dispensing bottle comprising a body injection molded as a single piece, the body being formed of a relatively soft elastomeric material, the body including a circular end wall, a generally cylindrical skirt at an outer periphery of the end wall defining a central axis and extending in one direction along the axis, the end wall having a central through hole and an outer face with a multitude of bristles distributed about the hole and extending axially from said face in a direction opposite the one direction, the skirt being of sufficient length so as to extend along the threads of a screw-on cap to retain the over cap brush on the cap by frictionally engaging the exterior of the skirt of the cap while the cap is disposed on a squeeze dispensing bottle.

9 Claims, 2 Drawing Sheets

OVER CAP BRUSH FOR DISPENSING BOTTLE

BACKGROUND OF THE INVENTION

The invention pertains to dispensers and applicators for sauces and other edible liquids of varying viscosity.

PRIOR ART

In the preparation of food, sauces, bastings, glazings, and other more less viscous liquids (hereinafter "sauces") are often applied to the food when broiling, frying, baking, and the like. Typically, the sauce is brushed onto the food product while it is being cooked. Traditionally, the sauce is disposed in a bowl, pan or other open container and the cook or chef wets a brush in the container and then applies the sauce to the food product. Several dips of the brush into the container may be required to transfer an adequate quantity to the food. Repeated dipping of the brush is time-consuming and makes it difficult to apply a uniform or consistent coating. Open bowls, pans, or like containers in a food preparation area is less than ideal from a sanitation standpoint. When sauces are applied by a brush and the brush is replenished frequently by dipping it into the container, there is a risk of dripping the sauce onto surrounding surfaces especially when the cook is hurried. If the container is hand-held close to the food being prepared, a person has to devote both hands to the task and, therefore, cannot simultaneously reposition or reorient the food being coated.

Another approach is to dispense the sauce from a container directly onto the food and then spread the deposits of sauce more evenly with a brush. The latter approach may require both hands and a fair degree of concentration or may require successive steps that increase the time involved.

These circumstances are especially acute in a commercial kitchen where mealtimes impose peak demands on personnel. A cook or cooks at these times are particularly busy and any time and/or labor-saving device or method is especially valuable.

At some foodservice establishments several flavors and/or types of sauces are offered on a menu and/or are used by the chef. Particularly in these circumstances, use of conventional brushes can lead to their mishandling, misplacing, and/or dipping into the wrong container. Still further, even where the sauce is applied from a dispensing container, there ordinarily needs to be a storage space or a brush dedicated to a particular sauce. All of these devices take up valuable counter space and, from time-to-time, lead to confusion.

SUMMARY OF THE INVENTION

The invention provides a novel elastomeric over cap brush for converting various squeeze bottle dispensers into brush dispensers. The resulting brush dispenser is ideally suited for use in the foodservice industry for applying sauces such as barbecue sauce and other liquids of various viscosities to food products including barbecue ribs, and other red meats, poultry, fish, as well as non-meat food products. The disclosed brush dispenser permits a sauce to be simultaneously dispensed and brushed onto the food object or material thereby saving labor and time and reducing the risk of mix-ups between containers or dispensers of a sauce and a brush dedicated to that sauce.

The invention improves on sanitation thereby affording a great benefit to commercial kitchens. The disclosed highly flexible non-slip nature of the brush body makes it extremely easy to install or remove from a rigid bottle cap with simple push-on, push-off hand movement. The brush is provided with bristles that, while great in number and soft in nature, are molded in an open pattern that makes the exterior of the brush relatively easy to clean and easy to inspect. The bristles, at the same time, are robust and large enough that they resist breakage, a problem existing with conventional brushes.

The flexibility of the over cap brush permits it interior including its inside corners, to be completely exposed for thorough machine or hand cleaning by simply turning the over cap brush inside out. The disclosed over cap brush, when produced in a given size, is advantageously compatible with standard commercially available dispensing caps of various styles, shapes, and actual molded dimensions. This saves both the supplier and customer the expense that would otherwise be incurred if a custom over cap brush was needed for the dispensing cap or caps of different styles and/or different manufacturers.

The disclosed over cap brush is easily installed and removed by virtue of its flexible, compliant sidewall design. The sidewall or skirt can be grasped and pressed at its top, since it is unencumbered by the bristles and it can be easily lifted by grasping its bottom edge since it stands radially away from the dispensing cap on which it is fitted. In the preferred embodiment, the sidewall is relatively thin and is caused to stand off the cap on which it is installed by a series of circumferentially spaced axially extending internal ribs. The ribs, besides supporting the sidewall off the dispensing cap for an easy grip, permit the brush to be pushed on or off the cap by reducing friction between the brush and cap. The ease with which the brush can be installed on or removed from a cap reduces the risk that a foodservice employee will ignore sanitation procedures calling for removal of the over cap brush from the dispensing container at appropriate times to effectuate a thorough cleaning.

DESCRIPTION OF THE PREFERRED EMBODIMENT

Figure 1:
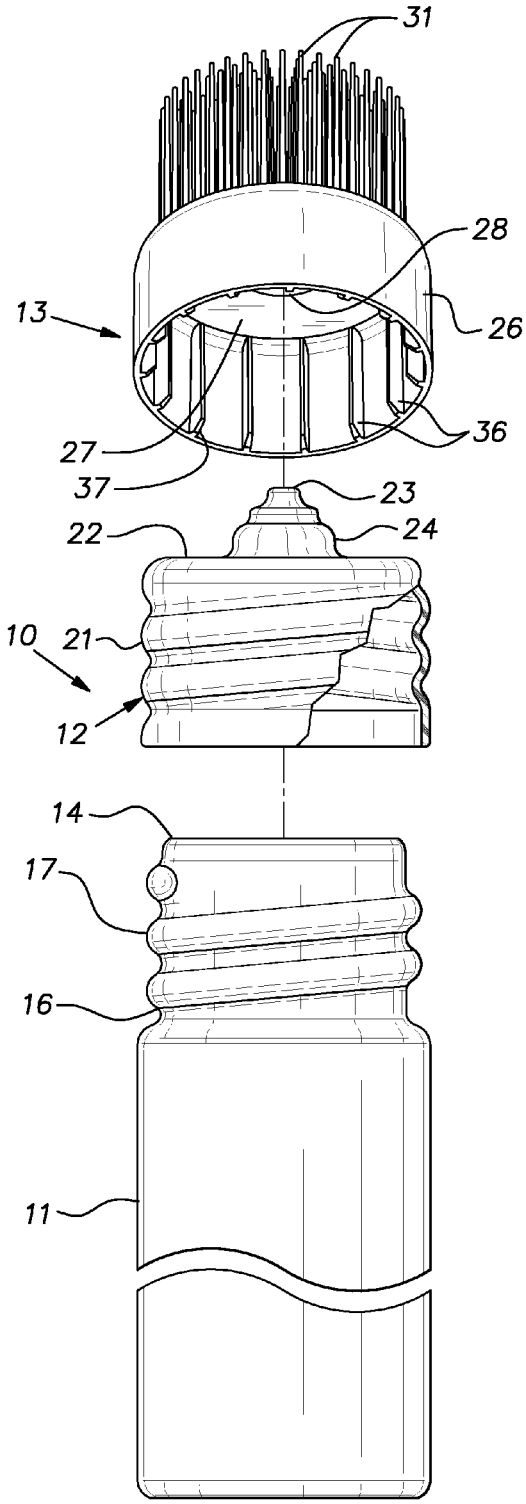
FIG. 1 is an exploded view of a squeeze bottle, dispensing cap and over cap brush that form a combined dispenser and brush assembly.
Figure 2:
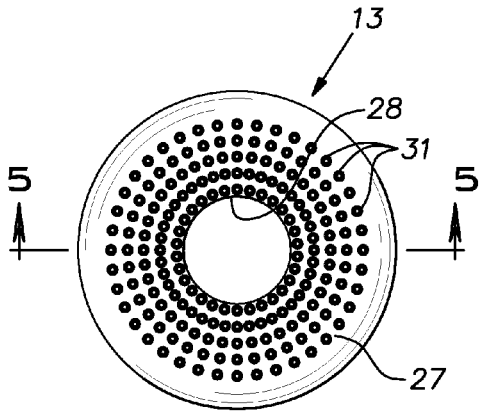
FIG. 2 is a top view of the over cap brush.
Figure 3:
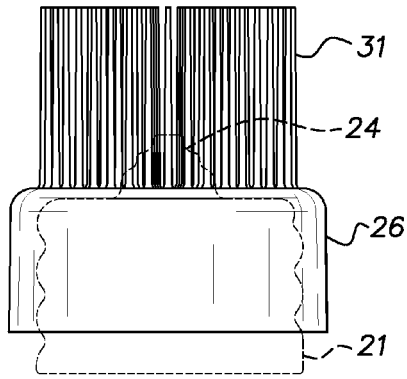
FIG. 3 is a side elevational view of the over cap brush with the dispensing cap shown in phantom and in assembled relation thereto.
Figure 4:
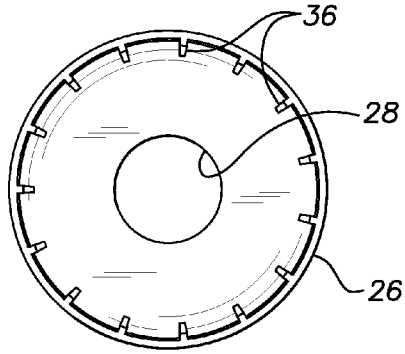
FIG. 4 is a bottom view of the over cap brush.
Figure 5:
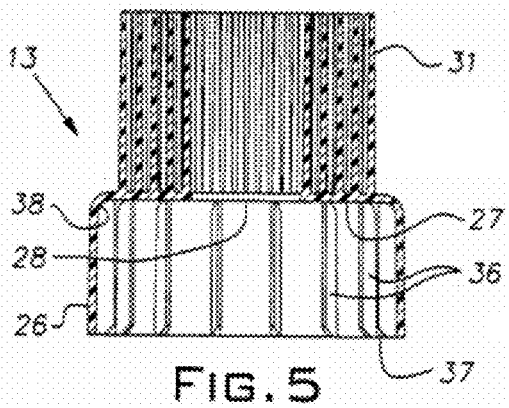
FIG. 5 is a cross-sectional view of the over cap brush taken in a vertical plane.

Referring now to the figures and in particular to FIG. 1, there is shown an exploded view of a combined dispenser and brush applicator for edible liquid food materials of varying viscosity such as sauces, bastes, glazings, oils, and the like, (hereinafter "sauces"). The combined dispenser and brush applicator unit 10 includes a bottle 11, cap 12, and over cap brush 13. The bottle 11 is of the squeeze-dispensing type and made of a suitable food grade plastic such as low density polyethylene with a nominal wall thickness of 1 mm. The bottle 11 is conveniently made by blow-molding, but can alternatively be injection blow-molded. The bottle 11 can be of the type disclosed in U.S. patent application Ser. No. 12/120,283, filed May 14, 2008, or can be a bottle with more conventional construction. The bottle 11, preferably, is cylindrical in shape, closed at its bottom end, and formed with a large neck opening 14 nearly the diameter of the cylindrical main body of the bottle. A neck 16 of the bottle has external threads 17.

The cap 12, also shown in the foregoing cited patent application, compared to the bottle 11, is relatively rigid, having relatively thick walls and being injection molded of high density polypropylene. By way of example, the cap 12 can have a wall thickness of, on average, about 2 mm. In contrast, the bottle wall thickness on average, is about 1 mm. The cap and bottle neck 16 have a nominal size of 63 mm. The cap 12 includes a generally cylindrical sidewall 21 and a circular end wall 22. The end wall 22 has a central dispensing hole or aperture 23. The central area of the end wall 22 is stepped to form a spout 24 so that the size of the dispensing hole can be increased by cutting off a portion of the spout at a height corresponding to the desired hole size. By way of illustration, but not limitation, the outside diameter of the cap is about 71 mm and the height of the cap, disregarding the raised central spout area, from the bottom of the sidewall 21 to the exterior of the end wall, disregarding the raised central area, is about 63 mm.

The cap has internal threads proportioned to mate with the external threads 17 of the bottle. When the cap 12 is screwed or threaded onto the neck 16 of the bottle and tightened, an effective seal is developed at the neck opening 14. The over cap brush 13 is injection molded of a suitable soft elastomeric material such as food grade silicone having a Shore hardness of about 55. The over cap brush 13 is injection molded in a single or unitary piece, i.e. all being formed of the same material at the same time. The brush includes a cylindrical sidewall or skirt 26 depending from a circular end wall 27 such that the sidewall and end wall are concentric about a common axis. The end wall is provided with a relatively large central aperture 28.

Brush bristles 31 extend from an outer face of the end wall 27 axially in a direction away from the skirt 26. The bristles are arranged in generally uniformly spaced circular rows concentric with the axis of the cap. The bristles are very long in comparison to their diameters. By way of example but not limitation, the bristles can be about 44 mm long and have their diameters tapering from less than about 2 mm where they are joined to the end wall 27 at their base, to about 1 mm at their free or distal ends. Stated otherwise, the bristles 31 have a length to width ratio of at least 20:1. The bristles 31, by virtue of the relatively soft material from which the over cap brush 13 is made and their slender configuration are relatively soft to the touch at their free ends thereby making it easy to uniformly apply a light brush pressure to an object being coated.

The over cap brush sidewall or skirt 26 has axially extending annularly or circumferentially spaced ribs 36. The ribs project inwardly from the sidewall 26 in planes radial to the axis of the cap. The radial extent of the ribs is about 4 mm, being roughly about twice the nominal thickness of about 2 mm of the sidewall proper by way of example, but not limitation. Ends 37 of the ribs 36 remote from the end wall 27 are beveled to facilitate assembly of the over cap brush 13 onto the cap 12.

Where the outer periphery of the brush end wall 27 merges with the sidewall 26, a rounded transition area exists such that an inside corner 38 has a radius of a dimension at least equal to the wall thickness of the over cap brush 13.

The over cap brush 13 is manually assembled onto or removed from the cap 12. The ribs 36 collectively leave an inside clearance diameter in a free state of about 65 mm which serves to provide an adequate interference fit with the cap 12 described above to retain the brush 13 on the cap 12 during even vigorous brushing action. Preferably, the axial length of the brush sidewall or skirt 26 is at least ¼ of the outer diameter of the brush so that it can establish a stable mount on the cap 12. It will be understood that the projecting spout 24 of the cap 12 can extend through the central aperture 28 of the over cap brush 13 so as to allow unencumbered dispensing of sauce or other flowable product out of the bottle 11 when the same is inverted and squeezed.

Figure 8:
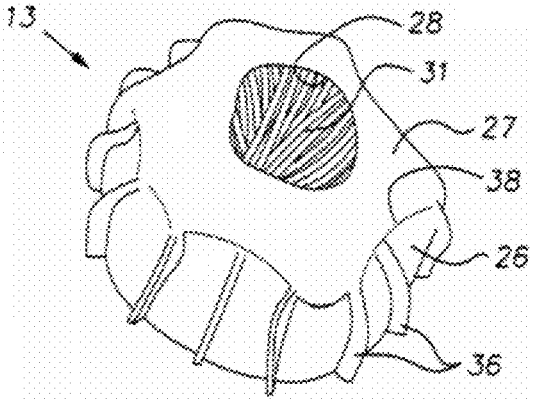
FIG. 8 is a perspective view of the over cap brush demonstrating its ability to be turned inside out for cleaning purposes.

The over cap brush 13 is easily installed on the cap 12 by simply pushing it axially onto the cap. The bristles are inward of the periphery of the end wall and the transition of the end wall into the sidewall so as to enable an axial force to be manually applied to the over cap brush and enable it to be readily installed on the cap. The ribs 36 serve to reduce the frictional contact area of the skirt 26 against the cap so as to reduce the effort required to position the over cap brush onto the cap. The ribs 36 also serve to hold the brush sidewall 26 away from the cap sidewall 21 thereby enabling a person to achieve an easy finger grip under the brush sidewall when it is desired to remove the brush from the cap. The over cap brush 13 can thus be easily removed from the cap 12 at appropriate times to sanitize these components. The over cap brush 13 can be machine or hand-washed. Moreover, even stubborn deposits on the inside of the over cap brush 13 can be easily removed by hand or machine washing by, as suggested in FIG. 8, turning the brush inside out, thereby fully exposing the inside corner 38 of the transition area between the sidewall 26 and end wall 27. The brush 13 is sufficiently resilient to completely restore itself to its original shape when it is turned right side out.

Figure 7:
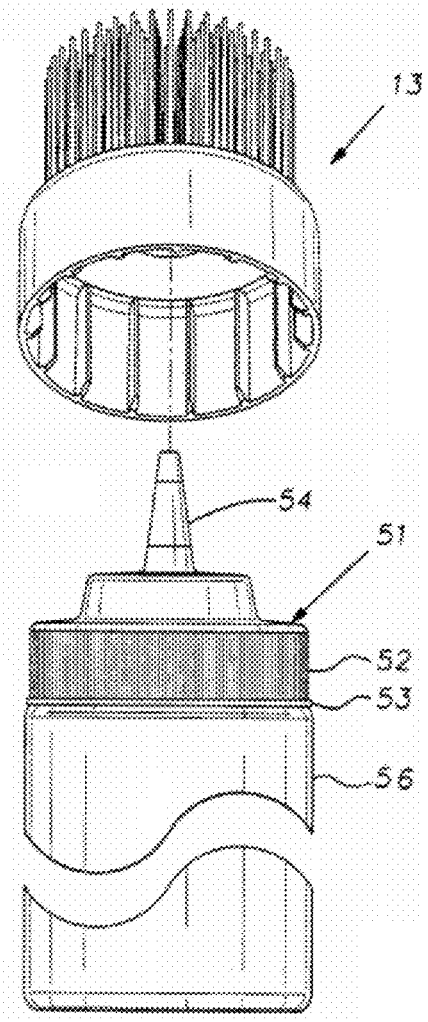
FIG. 7 is an exploded view of the over cap brush and another squeeze bottle and dispensing cap.
Figure 6:
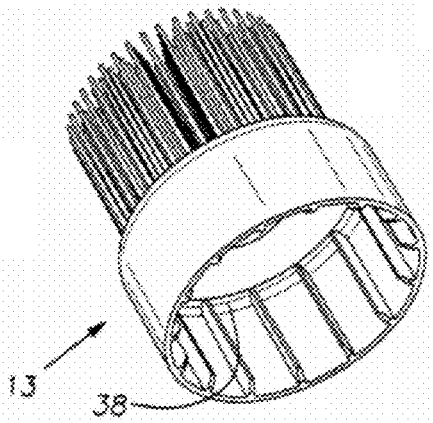
FIG. 6 is a bottom perspective view of the over cap brush.

FIG. 7 illustrates use of the same over cap brush 13 with a dispensing cap 51 of a common style. The dispensing cap 51 has a generally cylindrical skirt or sidewall 52 with a small peripheral lip 53 at its lower edge. The dispensing cap 51 has a nominal outside diameter measured at the skirt of 67 mm, while the small lip has an outer diameter of about 69 mm. The disclosed over cap brush 13 is adequately frictionally retained on the dispensing cap 51 despite the lesser interference existing between its minimum inside diameter and that of the skirt 52 and lip 53. Moreover, the brush skirt 26 is long enough to extend down over a portion of a bottle 56 on which the cap 51 is threaded. It will be also understood that a spout 54 of the dispensing cap 51 projects through the central aperture 28 of the over cap brush 13 and that the bristles 31 extend axially beyond this spout 54. It will also again be understood that the over cap brush 13 is installed on the dispensing cap 51 by simply pushing it on the same, and removed by pushing it axially off the cap. No extraneous motions or undue effort need be extended to accomplish the same which would otherwise be a disincentive for personnel to periodically sanitize these dispenser/applicator components.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. An over cap brush for a squeeze dispensing bottle comprising a body injection molded as a single piece, the body being formed of a relatively soft elastomeric material, the body including a circular end wall, a generally cylindrical skirt integrated with and extending continuously along an outer periphery of the end wall, the skirt defining a central axis and extending in one direction along the axis, said end wall and skirt being relatively thin compared to the length of the skirt, the end wall having a central through hole and an outer face with a multitude of bristles integral with the end wall, distributed about the hole and extending axially directly from said face in a direction opposite the one direction, the skirt being of sufficient length so as to be adapted to extend along multiple threads of a separate screw-on cap to retain the over cap brush on the cap by engaging an exterior of a sidewall of the cap in a threaded area of the sidewall while the cap is disposed on a squeeze dispensing bottle and being completely separable from the cap and wherein said skirt is at least as long in axial length than one-quarter of the diameter of the body.

2. An over cap brush as set forth in claim 1, wherein said bristles are disposed in circular rows concentric with said axis.

3. An over cap brush as set forth in claim 1, wherein the end wall and skirt merge at a transition area, the transition area having an inside radius greater in dimension than the wall thickness of either the end wall or skirt.

4. An over cap brush as set forth in claim 1, wherein the respective thicknesses of the end wall and skirt and the resilience of the body material permit the skirt and end wall to be turned inside out to facilitate thorough cleaning of the interior of the body.

5. An over cap brush as set forth in claim 1, wherein the skirt is formed with a plurality of angularly spaced internal ribs extending radially inward.

6. An over cap brush as set forth in claim 5, wherein said ribs extend along substantially the full length of the skirt.

7. An over cap brush as set forth in claim 1, wherein said bristles have a length to width ratio of at least 20:1.

8. A combination dispensing container and brush applicator comprising a cylindrical squeeze bottle of semi-rigid plastic material and having a circular mouth with external threads, a relatively rigid screw-on dispensing cap having a generally cylindrical sidewall with internal threads matching the bottle threads and an end wall with a central aperture, a one-piece injection molded elastomeric over cap brush, the brush having a circular end wall and cylindrical skirt at the periphery of the end wall and extending from the end wall, the brush end wall and skirt each proportioned to fit over the dispensing cap, the brush end wall having a central hole alignable with a dispensing aperture of the dispensing cap and a multitude of bristles extending axially from its end wall in a direction opposite the skirt, the brush skirt being proportioned with an interference fit on the dispensing cap sidewall sufficient to retain the over cap brush on the dispensing cap when the bottle is inverted and the bristles are used to brush material dispensed from the bottle through the aperture of the dispensing cap, the cap having a spout forming said dispensing aperture, said spout being arranged to extend through said central hole of said brush.

9. An over cap brush for a squeeze dispensing bottle comprising a body injection molded as a single piece, the body being formed of a relatively soft elastomeric material, the body including a circular end wall, a generally cylindrical skirt at an outer periphery of the end wall defining a central axis and extending in one direction along the axis, the end wall having a central through hole and an outer face with a multitude of bristles distributed about the hole and extending axially from said face in a direction opposite the one direction, the skirt being of sufficient length so as to be adapted to extend along threads of a screw-on cap to retain the over cap brush on the cap by frictionally engaging an exterior of a sidewall of the cap while the cap is disposed on a squeeze dispensing bottle, the end wall and skirt being relatively thin compared to the length of the skirt, the respective thicknesses of the end wall and skirt and the resilience of the body material permit the skirt and end wall to be turned inside out to facilitate thorough cleaning of the interior of the body.

* * * * *